United States Patent [19]

Kackstäedter et al.

[11] 4,057,387

[45] Nov. 8, 1977

[54] PROCESS FOR THE WHITENING OF TEXTILE FIBRES OF POLYESTERS

[75] Inventors: Klaus Kackstäedter; Hans Theidel, both of Leverkusen, Germany

[73] Assignee: Bayer Aktiengesellschaft, Leverkusen, Germany

[21] Appl. No.: 647,409

[22] Filed: Jan. 8, 1976

[30] Foreign Application Priority Data

Jan. 11, 1975 Germany ..... 2500915

[51] Int. Cl.[2] ..... D06P 1/38

[52] U.S. Cl. ..... 8/1 W; 8/21 C; 8/22; 8/54; 8/54.2; 8/89 R; 8/92; 8/179; 252/301.21; 252/301.33

[58] Field of Search ..... 8/1 W, 89 R, 92; 252/301 WT, 301.21, 301.33

[56] References Cited

U.S. PATENT DOCUMENTS

| | | | |
|---|---|---|---|
| 3,347,617 | 10/1967 | Ulrich et al. | 8/42 |
| 3,758,460 | 9/1973 | Schroeder et al. | 260/240 D |
| 3,784,511 | 1/1974 | Kirby | 260/45.95 P |

FOREIGN PATENT DOCUMENTS

| | | |
|---|---|---|
| 1,300,489 | 6/1962 | France. |
| 2,254,498 | 6/1973 | Germany. |
| 1,594,834 | 11/1971 | Germany. |
| 7,214,842 | 5/1973 | Netherlands. |
| 1,359,095 | 7/1974 | United Kingdom. |
| 1,371,781 | 10/1974 | United Kingdom. |

*Primary Examiner*—Joseph L. Schofer
*Assistant Examiner*—A. L. Clingman
*Attorney, Agent, or Firm*—Plumley & Tyner

[57] ABSTRACT

Process for whitening textile fibres of polyesters or blended fibres of polyesters and cellulose or wool with dispers fluorescent whitening agents according to a combined exhaustion and thermo-fixing process, in the presence of auxiliaries e.g. esters in combination with water-soluble alkali metal salts or ampholytes which are capable of forming an aqueous two-phase system.

3 Claims, No Drawings

PROCESS FOR THE WHITENING OF TEXTILE FIBRES OF POLYESTERS

The subject of the invention is a process for the whitening of textile fibres of polyesters or blended fibres of polyesters and cellulose or wool with disperse fluorescent whitening agents ("FWA" in the following) by a combined exhaustion and thermofixing process in the presence of auxiliaries which are capable of forming an aqueous two-phase system under the conditions of the exhaustion process.

The auxiliaries are characterised in that they contain an ester in combination with a water-soluble alkali metal salt or an ampholyte.

Preferred esters are reaction products of alkylene oxides with fatty acids or abietic acid, as well as phthalic acid esters and phosphoric acid esters.

Suitable alkoxylated fatty acids are described, for example, in K. Lindner "Tenside, Textilhilfsmittel, Waschrohstoffe" ("Surface-active Agents, Textile Auxiliaries and Detergent Raw Materials"), Volume I, (1964), page 898 et seq. In particular, $C_{12}$–$C_{18}$-alkylcarboxylic acids with 4–50 ethylene oxide units, such as oleic acid hexaethylene glycol ester, heptaethylene glycol ester or dodecaglycol ester, and the reaction products of stearic acid and ricinoleic acid with 40 mols of ethylene oxide, are suitable.

Examples of suitable phthalic acid esters are alkyl, aralkyl and aryl esters, in particular $C_1$–$C_4$-alkyl esters, such as phthalic acid dimethyl ester and di-n-butyl ester, and phthalic acid diphenyl ester. Examples of suitable phosphoric acid esters are phosphoric acid trialkyl esters or triaryl esters, especially those with 1–8 C atoms in the alkyl radical, such as phosphoric acid tri-n-butyl ester and phosphoric acid triphenyl ester.

Examples of suitable abietic acid esters are reaction products of abietic acid with 30 to 60 mols of ethylene oxide.

Preferred water-soluble alkali metal salts are alkali metal sulphates, alkali metal phosphates, alkali metal aluminium sulphates or alkali metal tetraborates. Sodium and potassium salts of sulphuric acid and polyphosphoric acids should be singled out particularly. Examples of such salts of polyphosphoric acid are described in K. Lindner "Tenside, Textilhilfsmittel, Waschrohstoffe" ("Surface-active Agents, Textile Auxiliaries and Detergent Raw Materials"), Volume II (1964), page 1,171 et seq.

Ampholytes to be employed are the categories of compounds in K. Lindner "Tenside, Textilhilfsmittel, Waschrohstoffe" ("Surface-active Agents, Textile Auxiliaries and Detergent Raw Materials"), Volume I, pages 1,025–1,041. Examples which may be mentioned are betaines such as dodecyldimethyl-aminoacetic acid or stearyl-dimethyl-$\beta$-aminopropanesulphonic acid, aminocarboxylic acids, aminosulphuric acids or aminophosphoric acids or ampholytes which are produced from cationic compounds by introduction of acid radicals, such as oleylamido-ethyl-dimethyl-aminoacetic acid, or alkali metal salts of N-$C_{15}$-$C_{17}$-alkyl-polyalkylene glycol-taurides, with, for example, from 20 to 30 ethylene oxide units.

The polyester fibres to be treated in accordance with the process of the invention are described, for example, in the fibre material tables of P. A. Koch "Textilveredlung", September 1973, page 435 et seq.

Representatives of the disperse FWA are described, for example, in British Patent Specifications Nos. 1,201,759, 1,225,224 and 1,313,253, in U.S. Pat. No. 3,758,460 and in German Auslegeschrift (German Published Specification) No. 1,594,834.

The following may be mentioned as examples of such FWA's:

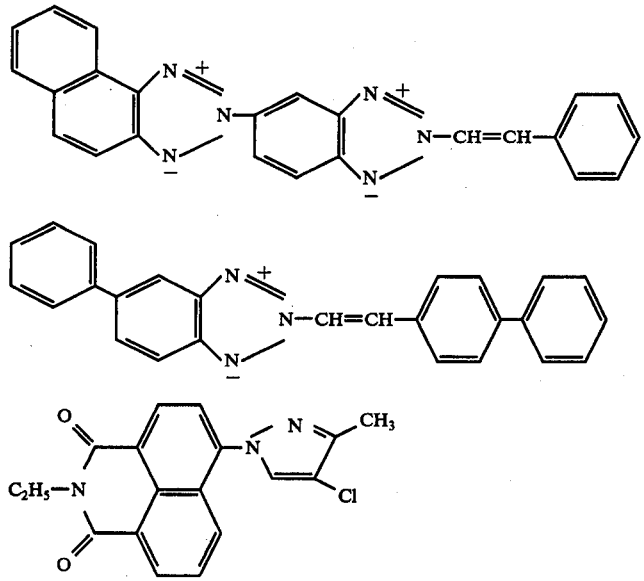

-continued
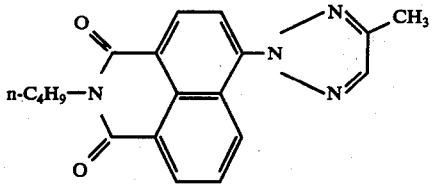
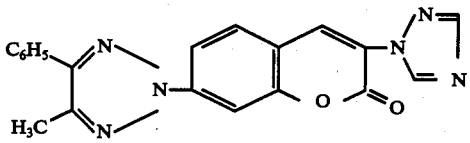
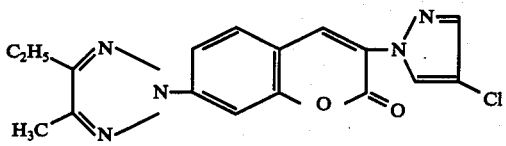
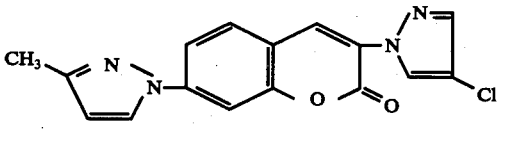
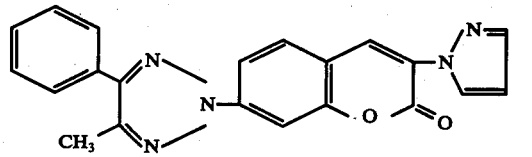
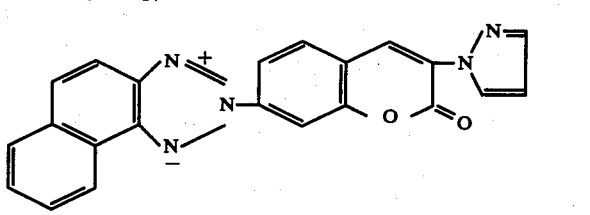
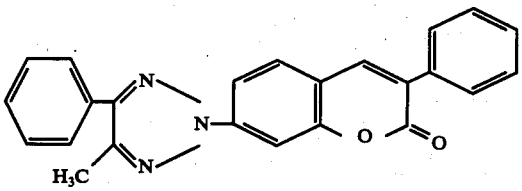
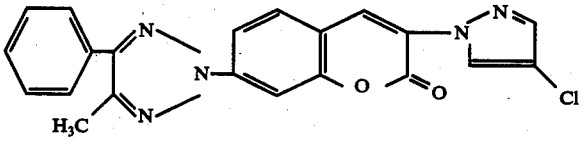
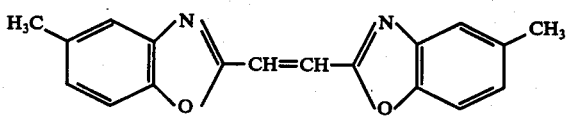
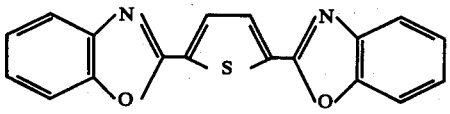

-continued
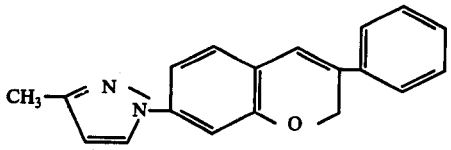
(1)
+
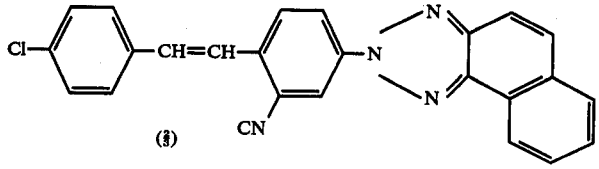
(2)
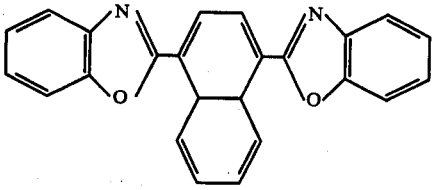
(3)
+
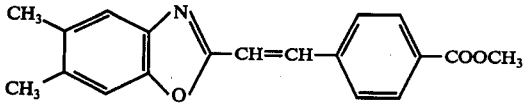
(4)
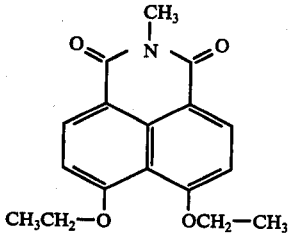
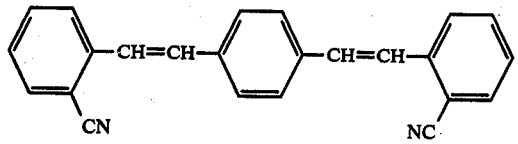
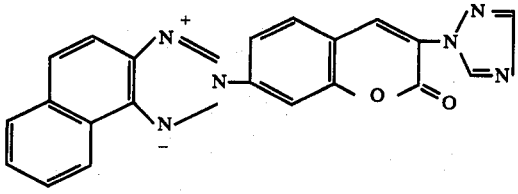
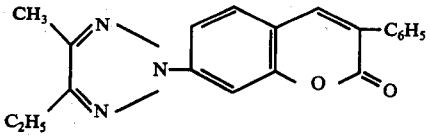
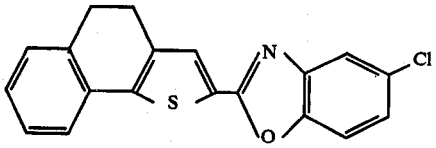

-continued

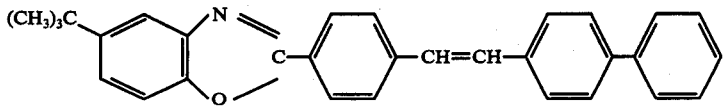

Disperse FWA's from the coumarin and styrylbenzotriazolyl series, above all coumarin derivatives which are substituted in the 3-position by pyrazolyl or 1,2,4-triazolyl radicals and in the 7position by 1,2,5-triazolyl radicals, are preferred.

The auxiliaries which can be used according to the invention can form a two-phase system in the aqueous liquor. This system is a colloidal solution which is capable of coacervation under the conditions of the FWA.

According to H. Staudinger ("Organische Kolloidchemie" ("Organic Colloid Chemistry"), Friedr. Vieweg u. Sohn, Braunschweig (1950), page 275) coacervation in colloids means an equilibrium state between solution and flocculation in which the dissolved particles are still solvated, but their solvate shells are no longer miscible with the remaining free solvents. This state results from a decrease or elimination of hydration and/or charges, for example as a result of the addition of dehydrating substances such as salts, alcohols or colloids of opposite charge.

Further auxiliaries can be added to the liquor to be used according to the invention, for example a. anti-foaming agents, such as silicone oils, b. non-ionic, surface-active compounds such as alkylaryl polyglycol ethers, for example nonylphenyl decaethylene glycol ether, alkyl polyglycol ethers, for example reaction products of oleyl alcohol with 5–20 mols of ethylene oxide, or aminopolyglycol ethers, for example reaction products of $C_{16}$–$C_{18}$-alkylamines or $C_{16}$–$C_{18}$-alkyl-hydroxybenzylamines with 10–20 mols of ethylene oxide, and c. bleaching agents, such as hydrogen peroxide or sodium chlorite, for bleaching the cellulose fibre constituent in the case of polyester-cellulose fibre blended fabrics.

An advantageous embodiment to be singled out is a process in which the surface-active compounds, mentioned under b), which are employed are those which simultaneously clean oily and fatty fibre deposits from the crude fibre. This embodiment permits production of the whitened material from the crude fibre in a single process step. Detergent materials to be used in this case are preferably reaction products of $C_{16}$–$C_{18}$-alkylbenzylamines or -hydroxylbenzylamines with 10–20 mols of ethylene oxide.

The process is carried out as follows:

The textile materials are treated for 15–60 minutes in the FWA liquors, which contain the auxiliaries according to the invention, using a liquor ratio of 1:5 to 1:40, at 30°–100° C, preferably at 50°–85° C.

It can be of advantage to introduce the textile fabric into a liquor which in addition to the FWA initially only contains an alkali metal salt or an ampholyte, and only to add the ester after heating-up, for example to 80° C, and then to maintain the temperature for a further period, for example for 15 minutes. The liquor can, from the start, contain one or more auxiliaries which lie outside the invention. Thereafter, when the bath has cooled, the fabric is rinsed thoroughly in the usual manner, for example with water which has not been softened.

Only the textile material treated in the manner described above at 30°–40° C is rinsed with soft or softened water.

The goods are then centrifuged. The FWA is subsequently fixed to the fibre material by brief heating, for example for 20 seconds, to 150°–200° C, preferably 170°–190° C. The process can be carried out on the conventional dyeing apparatuses and dyeing machinery, for example winches, jet-dyeing apparatuses, beam-dyeing apparatuses or jiggers.

The amounts in which the auxiliaries to be used according to the invention must be present in the FWA liquors in order to achieve optimum whitening effects can easily be determined by preliminary experiments; in general it has proved appropriate to use 0.25–1 g/l of the ester and 4–10 g/l of the alkali metal salt or 0.5–2 g/l of the ampholytic auxiliary.

Using the process according to the invention it proves possible to achieve excellent whiteness effects under gentle conditions, that is to say with short treatment times and at low temperatures. The whiteness effects are greater than those obtainable in accordance with previously known processes under identical temperature/time conditions. The increase in the whiteness effect is, depending on the disperse FWA used, 2–30% (assessed according to A. Berger, compare "Die Farbe", Volume 8, 1959, Issue 4–6) relative to the whiteness achieved in accordance with the carrier process. This increase is particularly advantageous in the case of FWA with which an optimum whiteness effect is only achieved at high dyeing temperatures, for example at 130° C, if the auxiliaries to be employed according to the invention are not added.

The whitenings achieved in accordance with the process of the invention have good fastness to light and to wet processing.

Further advantages of the process are that extensive utilisation or exhaustion of the liquors is ensured. As a result, there is little contamination of the factory effluents. Furthermore, it is also possible to add the amounts of FWA dispersion, and auxiliaries according to the invention, required for a renewed whitening treatment, to the exhausted baths.

The parts mentioned are parts by weight.

EXAMPLE 1

100 parts of a ready-to-dye knitted fabric of texturised polyethylene glycol terephthalate fibres are completely wetted in 3,000 parts of softened water in a winch. 1 g/l of the sodium salt of a reaction product of n-$C_{15}$-$C_{17}$-alkyl-tauride and 30 mols of ethylene oxide, and 1.2 parts of an aqueous FWA dispersion which contains, per liter, 70 g of the FWA A, of which the formula is given later, are added thereto. The liquor is thereafter rapidly heated to about 65° C, then heated to 80° C at about 1° C/minute, and kept at this temperature for 10 minutes. 1 g/l of a product which consists of 50 parts of oleic acid hexaethylene glycol ester and 50 parts of a nonylphenyl decaethylene glycol ether are then added. The temperature is kept at 80° C for a further 15 minutes.

Thereafter, the bath is allowed to cool to about 60° C, with the heating switched off and with the goods continuing to circulate. The practically completely exhausted FWA liquor is then run out and cold, unsoftened tap water (about 15° German hardness) is added for the purpose of rinsing.

The goods are then taken out of the winch, centrifuged, and dried by hot air treatment, and fixed for 30 seconds at 175° C, on a dry fixing frame.

The whitening of this textile material is intense, very brilliant and of a reddish-tinged shade.

The light fastness according to DIN 54,004 is as high as grade 7, and the wet fastness properties according to DIN 54,006, 54,014, 54,010, 54,012 and 54,035 are as high as grade 5. The whiteness determined colorimetrically (according to Berger) is 150.42 compared to 135.15 of a whitening produced in the usual manner at the boil with benzoic acid benzyl ester as the carrier.

Instead of the FWA A, the FWA B or H can also be employed with very good success. For example, using otherwise the identical procedure, 2 parts of a dispersion of the FWA B, which contains 100 g/l of the active compound, gives a whiteness (according to Berger) of 147.05 on the same material, as compared to 112.95 for a whitening produced at the boil in the presence of benzoic acid benzyl ester.

If instead of 1 g of the abovementioned sodium salt 5 g/1 of sodium sulphate or 5 g/1 of sodium hexametaphosphate are employed, whitenings of comparable intensity are obtained.

Instead of the mixture of oleic acid hexaglycol ester and nonylphenol decaglycol ether, 1 g/l of triphenyl phosphate can be employed with good success.

EXAMPLE 2

1.0 parts of the dispersion of the FWA A used in Example 1, 5 g/l of sodium sulphate and 0.5 g/l of a mixture which consists of 65 parts of nonylphenol heptaglycol ether, 9 parts of an oleyl alcohol oxethylated with 20 ethylene oxide units, 9 parts of a benzyl-hexadecylamine oxethylated with 20 ethylene oxide units, 8 parts of isopropanol, 15 parts of ethylene glycol and 9 parts of water are added to 100 parts of a knitted fabric, which has not yet been pre-cleaned and pre-set, of texturised polyethylene glycol terephthalate fibres, which are present in a winch together with 3,000 parts of normal tap water (heavy metal content <0.2 mg/l) which has a hardness of 15° German hardness.

The bath is then rapidly heated to about 65° C and thereafter heated at about 1° C/minute to 80° C and kept at this temperature for 10 minutes; 1 g/l of an oleic acid hexaethylene glycol ester is then added and the bath is kept constant at 80° C for a further 15 minutes.

The liquor is then allowed to cool to about 60° C with the heating switched off and the goods continuing to circulate. Thereafter the practically exhausted bath is run out and cold, non-softened tap water of about 15° German hardness is allowed to run in for the purpose of rinsing the textile material.

After thorough rinsing, the goods are taken out of the winch, centrifuged, and dried by a hot air treatment and fixed for 30 seconds at 175° C, on a dry fixing frame. The whitening of this knitted fabric is intense, very brilliant and of a reddish-tinged shade.

The light fastness and wet fastness properties correspond to the values gives under Example 1.

The colorimetrically determined whiteness (according to Berger) is 151.69 as against 137.73 of a corresponding whitening produced in the customary manner at the boil with benzoic acid benzyl ester as the carrier, or as against 107.78 of a whitening produced at the boil, but without addition of textile auxiliaries or carriers.

EXAMPLE 3

100 parts of a ready-to-dye fabric of polyethylene glycol terephthalate fibres are completely wetted in 3,000 parts of softened water in a winch, and 2.0 parts of an aqueous FWA dispersion which contains 100 g/l of the FWA B, and 5 g/l of sodium sulphate, are added. The bath is subsequently heated rapidly to about 65° C and then at about 1° C/minute to 80° C, and is kept at this temperature for 10 minutes. 1.5 g/l of a product which consists of 50 parts of oleic acid hexaethylene glycol ester and 50 parts of a nonylphenol decaethylene glycol ether are then added. Thereafter, the procedure followed is as in Example 2.

The whitening of the fabric is intense and of high brilliance. The colorimetrially determined whiteness (Berger) is 130.08 as against 84.85 for the fabric which has not been whitened. In place of the FWA B, the FWA L can be used with equally good success, giving a comparably good result. Using in other respects the same procedure, on the same material, 0.8 part of an aqueous FWA dispersion which contains 100 g/l of the FWA L gives a whiteness (according to Berger) of 156.28. After conventional whitening at the boil, for example in the presence of benzoic acid benzyl ester as the carrier, practically no visible whitening is obtained.

EXAMPLE 4

0.3 part of a FWA dispersion which contains 240 g/l of the FWA E, and 1 g/l of the sodium salt of a reaction product of n-$C_{15}$-$C_{17}$-alkyltauride and 30 mols of ethylene oxide are added to 100 parts of a ready-to-dye fabric of polyethylene glycol terephthalate fibres and cellulose fibres in the ratio of 65:35, which are present in a winch in 3,000 parts of softened water.

The bath is heated as described in Examples 1–3, and is kept for 10 minutes at 80° C. 1 part of a product which consists of 50 parts of oleic acid hexaethylene glycol ester and 50 parts of nonylphenyl decaethylene glycol ether are then added. Thereafter the procedure followed is as in Examples 1 to 3. The blended fabric is intensely whitened in this way, and has a very brilliant appearance. The light fastness and wet fastness properties are very good. The whiteness of the textile material (according to Berger) is 124.40, as against 71.65 for the fabric which has not been whitened.

Instead of the FWA E, the FWA F or G can also be used. Instead of the sodium salt of the reaction product of n-$C_{15}$-$C_{17}$-alkyltauride and 30 mols of ethylene oxide, 5 g/l of potassium aluminium sulphate or sodium sulphate can be used with equally good success.

EXAMPLE 5

On a laboratory jigger with an automatic device for altering the running direction, 0.38 kg of a smooth, ready-to-dye fabric of polyethylene terephthalate fibres is completely wetted between two passes in the dyeing trough, which contains 29.1 g of sodium sulphate dissolved in 1.48 l of softened water. Thereafter, 2.7 ml of the dispersion of the FWA. A used in Example 1, which dispersion has beforehand been diluted to 200 ml with softened water, are added in the course of two passes. The liquor is then heated to 80° C. After running for 10 minutes, a previously prepared charge of 2.8 g/l of a mixture of 50 parts of oleic acid hexaethylene glycol ester and 50 parts of nonylphenol decaethylene glycol ether in 200 ml of (softened) water are added in the course of two passes. Thereafter, the liquor is heated to 90° C and the treatment is continued at this temperature for 20 minutes. The liquor is then run off and the textile material is rinsed in the usual manner by running in cold tap water. After running off the rinsing bath, the fabric is taken out of the jigger, centrifuged and dried and fixed by a hot air treatment on a dry fixing frame at 175° C for 30 seconds. The brilliant whitening of the fabric was measured colorimetrically. This gave a value, according to Berger, of 120.72 as against 70.51 for the textile material which had not been whitened.

It is also possible to use, with equally good success, the FWA C or D and, as auxiliaries, sodium hexametaphosphate as well as a product which consists of 50 parts of abietic acid ester ethoxylated with 50 ethylene oxide units and 50 parts of nonylphenol decaethylene glycol ether.

EXAMPLE 6

10 parts of a ready-to-dye fabric of polyethylene terephthalate fibres and cellulose fibres in the ratio of 65:35 are completed wetted in 170 parts of softened water in a dyeing beaker.

Thereafter, these additives are added to the bath, in the sequence shown:

1. A solution of 1 part of hydrogen peroxide (30% strength), 0.4 part of waterglass (25% of $SiO_2$) and 0.03 part of magnesium sulphate in 20 parts of water.
2. 1 part of sodium sulphate in 10 parts of water.
3. 0.05 part of the dispersion of the FWA A of Example 1.
4. 0.3 part of a mixture of 50 parts of oleic acid hexaethylene glycol ester and 50 parts of nonylphenol decaethylene glycol ether.

The liquor prepared in this way is heated to 85° C in the usual manner, and kept at this temperature for 1 hour. In doing so, the textile material is kept in constant movement under the liquor.

The fabric sample is then rinsed thoroughly and dried, and fixed for 30 seconds at 175° C, as described earlier. A very good whitening is achieved by this bleaching combined with whitening, carried out in one bath. The colour measurement according to Berger gave a value of 100.84 as against 77.94 after a bleaching without whitening carried out in the same manner. The measurement on the untreated fabric is 65.08.

Instead of the FWA A, the FWA H can be used with comparably good result.

EXAMPLE 7

10 parts of a fabric as described in Example 6 are completely wetted in 170 parts of softened water in a dyeing beaker. Thereafter the following additives are added in the sequence shown:

1. 0.2 part of sodium nitrate in 10 parts of water.
2. 0.3 part of sodium chlorite (50% strength) in 10 parts of water.
3. 1 part of sodium sulphate in 10 parts of water.
4. 0.05 part of the dispersion of the FWA A used in Example 1.
5. Formic acid until a pH value of 3.5 is reached.
6. 0.3 part of a mixture of 50 parts of oleic acid hexaethylene glycol ester and 50 parts of nonylphenol decaethylene glycol ether.

The further treatment of the goods to be dyed takes place as described under Example 6.

The outstandingly whitened fabric was measured colorimetrically and gave a value of 124.56 as against 78.45 after a bleaching treatment, without whitening, carried out in the same manner. The untreated fabric gave a measurement of about 65.08.

EXAMPLE 8

10 parts of a fabric as described in Example 6 are completely wetted in 165 parts of normal tap water (heavy metal content less than 0.2 mg/l) which has a hardness of 15° German hardness, in a dyeing beaker. Thereafter the following additives are added in the sequence shown:

1. 0.2 part of sodium nitrate in 10 parts of water.
2. 0.3 part of sodium chlorite (50% strength) in 10 parts of water.
3. 1.2 parts of sodium hexametaphosphate in 15 parts of water.
4. 0.05 part of the dispersion of the FWA A used in Example 1.
5. 0.03 part of an aqueous solution of the FWA K, which contains 11% of the FWA.
6. Formic acid until a pH value of 3.5 is reached.
7. 0.3 part of a mixture of 50 parts of oleic acid hexaethylene glycol ester and 50 parts of nonylphenol decaethylene glycol ether.

The further treatment of the dyed goods is carried out as indicated under Example 6. This bleaching and whitening, carried out in one bath, of both fibre constituents of the fabric, whereby the polyester constituent is optimally whitened by the FWA K and the cotton constituent is optimally whitened by the cellulose FWA K gives a very good whitening of high fastness to light. The colorimetric values according to Berger are 128.51 as against 84.75 after a bleaching treatment, without whitening, carried out in the same manner. The untreated fabric gives a measurement of 65.08.

The FWA used in the examples have the formula:

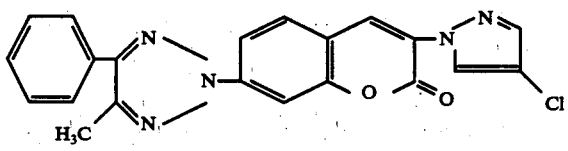

A

-continued
B
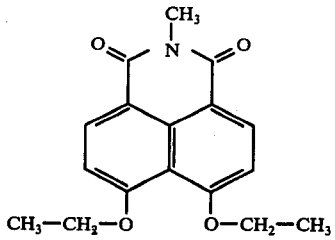
C
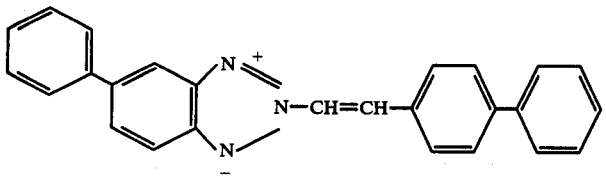
D
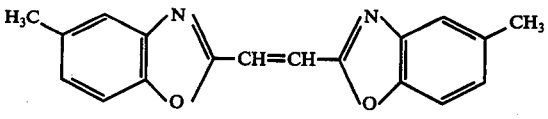
E
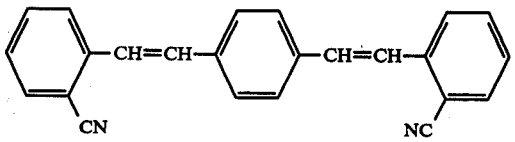
F
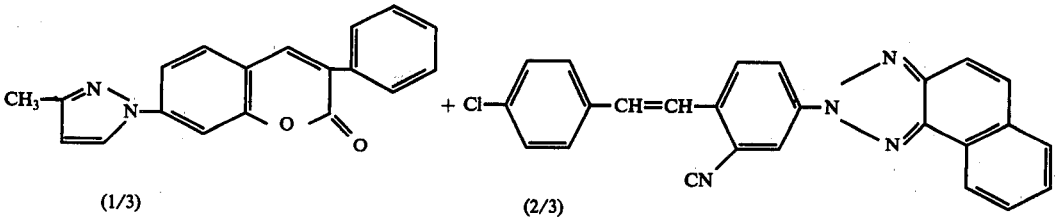
(1/3) (2/3)
G
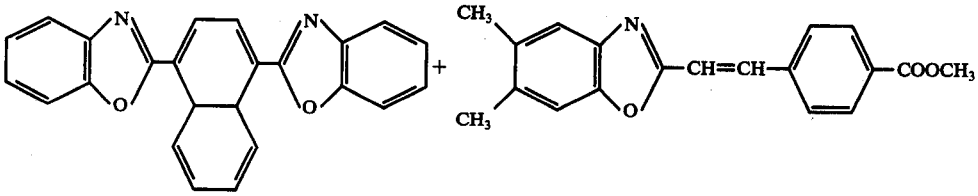
(2/3) (1/3)
H
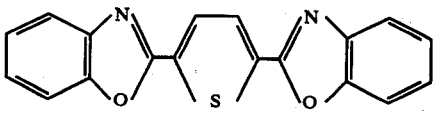
K
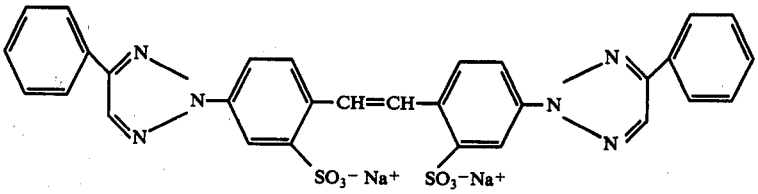
L
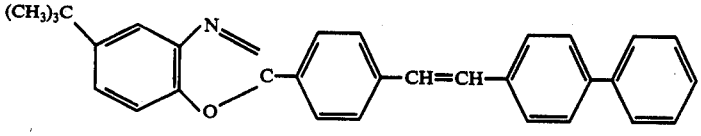
I claim:
1. In the process for whitening textile fibers of polyester, of polyester blended with cotton or of polyester blended with wool, with a dispersed fluorescent whitening agent by the process of exhaustion from an aqueous liquor and subsequent thermofixation; the improvement comprising enhancing the whitening effect by utilizing a two-phase aqueous liquor containing an ester capable of forming a second phase and a water-soluble alkali metal salt or an ampholyte.

2. Process of claim 1 in which said ester is an alkoxyalkyl fatty acid ester, an alkoxyalkyl abietic acid ester, a phthalic acid ester or phosphoric acid ester; and said water-soluble alkali metal salt is alkali metal sulphate, alkali metal phosphate, alkali metal aluminum sulphate or alkali metal tetraborate.

3. Process of claim 1 in which said two-phase liquor contains 0.25–1 g/l of said ester and 4–10 g/l of the alkali metal salt or of the ampholyte.

* * * * *